US006910450B2

(12) United States Patent
Katayama

(10) Patent No.: US 6,910,450 B2
(45) Date of Patent: Jun. 28, 2005

(54) VARIABLE VALVE TIMING STRUCTURE FOR OUTBOARD MOTOR ENGINE

(75) Inventor: Goichi Katayama, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 356 days.

(21) Appl. No.: 09/870,619

(22) Filed: May 31, 2001

(65) Prior Publication Data

US 2002/0014214 A1 Feb. 7, 2002

(30) Foreign Application Priority Data

May 31, 2000 (JP) ..... 2000-163084
May 31, 2000 (JP) ..... 2000-163285

(51) Int. Cl.[7] ..... F01L 1/34

(52) U.S. Cl. ..... 123/90.17; 123/90.15; 74/568 R

(58) Field of Search ..... 123/90.15, 90.16, 123/90.17, 90.18; 74/568 R; 464/1, 2, 160

(56) References Cited

U.S. PATENT DOCUMENTS 5,012,773 A 5/1991 Akasaka et al.
5,058,539 A 10/1991 Saito et al.
5,111,780 A 5/1992 Hannibal (Continued)

FOREIGN PATENT DOCUMENTS

DE 3613945 A1 4/1986
EP 0 356 162 A1 8/1989
EP 0 452 671 A2 3/1991
EP 0 583 584 A1 6/1993
EP 0 699 831 A2 8/1995
EP 0 808 997 A1 5/1997
EP 0 829 621 A2 9/1997
EP 0 834 647 A1 10/1997
JP 411132016 A1 * 5/1999
JP 411210425 A1 * 8/1999

OTHER PUBLICATIONS

Co–pending patent application, filed May 31, 2001, entitled Four–Cycle Engine for Marine Drive, in the name of Goichi Katayama, and assigned to Sanshin Kogyo Kabushiki Kaisha.

*Primary Examiner*—Thomas Denion
*Assistant Examiner*—Jaime Corrigan
(74) *Attorney, Agent, or Firm*—Knobbe, Martens, Olson & Bear, LLP.

(57) ABSTRACT

An internal combustion engine for an outboard motor that comprises at least one combustion chamber formed by at least a engine body, a cylinder head assembly and a piston that moves relative to the engine body and the cylinder head assembly. A crankshaft extends in a generally vertical direction and is coupled to the piston such that movement of the piston causes the crankshaft to rotate. A camshaft is journaled for rotation and extends generally parallel to the crankshaft. The camshaft includes at least one cam configured to open and close a valve. A control valve for a variable valve timing mechanism is positioned within a common hydraulic passage having a first opening and a second opening. The control valve is positioned generally along an axis that is perpendicular to the camshaft.

54 Claims, 9 Drawing Sheets

U.S. PATENT DOCUMENTS 5,133,310 A 7/1992 Hitomi et al.
5,143,034 A 9/1992 Hirose
5,150,675 A 9/1992 Murata
5,184,578 A 2/1993 Quinn, Jr. et al.
5,184,581 A 2/1993 Aoyama et al.
5,189,999 A 3/1993 Thoma
5,289,805 A 3/1994 Quinn, Jr. et al.
5,301,639 A 4/1994 Satou
5,305,718 A 4/1994 Müller
5,353,755 A 10/1994 Matsuo et al.
5,458,099 A 10/1995 Koller et al.
5,460,130 A 10/1995 Fukuzawa et al.
5,474,038 A 12/1995 Golovatai-Schmidt et al.
5,540,197 A 7/1996 Golovatai-Schmidt et al.
5,592,907 A 1/1997 Hasebe et al.
5,606,941 A 3/1997 Trzmiel et al.
5,669,343 A 9/1997 Adachi
5,694,912 A * 12/1997 Gotou et al. ..... 123/674
5,704,315 A 1/1998 Tsuchida et al.
5,713,319 A 2/1998 Tortul
5,718,196 A 2/1998 Uchiyama et al.
5,722,356 A 3/1998 Hara
5,797,363 A 8/1998 Nakamura
5,799,631 A 9/1998 Nakamura
5,816,204 A 10/1998 Moriya et al.
5,829,399 A 11/1998 Scheidt et al.
5,901,674 A * 5/1999 Fujiwaki ..... 123/90.17
5,924,396 A 7/1999 Ochiai et al.
6,032,629 A 3/2000 Uchida
6,035,817 A 3/2000 Uchida
6,076,492 A 6/2000 Takahashi
6,129,060 A 10/2000 Koda
6,186,104 B1 2/2001 Torii et al.

* cited by examiner

VARIABLE VALVE TIMING STRUCTURE FOR OUTBOARD MOTOR ENGINE

PRIORITY INFORMATION

This application is based on and claims priority to Japanese Patent Applications No. 2000-163084, filed May 31, 2000 and No. 2000-163285, filed May 31, 2000, the entire contents of which are hereby expressly incorporated by reference.

BACKGROUND OF THE INVENTION

1. Field of the Invention

This invention generally relates to a variable valve timing structure, and more particularly relates to a variable valve timing structure for an outboard motor.

2. Description of Related Art

A typical outboard motor comprises a power head and a housing unit depending from the power head. The power head includes an internal combustion engine that drives a marine propulsion device (e.g., a propeller) through a driveshaft and a propulsion shaft, which are both journaled within the housing unit. The marine propulsion device is attached to the end of a propulsion unit, which extends from housing unit and is in a submerged position.

There is an increasing emphasis on obtaining more effective emission control, better fuel economy and, at the same time, continued high or higher power output in outboard motors. Accordingly, four-cycle engines have started to replace two-cycle engines in outboard motors. However, it is difficult to arrange all the components of a four-cycle engine into the limited of space of an outboard motor cowling.

It is also desirable to achieve good emission control, fuel economy and high power output during the entire speed and load range of the outboard motor. In automotive four-cycle engines, there have been proposed a wide variety of devices to permit the engine characteristics to be adjusted during operation to obtain optimum performance across the entire speed and load range. One such device is a variable valve actuating mechanism, which includes both changing valve timing and/or the valve lift. The valve timing usually is advanced in the high engine speed range to effect higher charging efficiency and higher performance. At lower engine speeds, the timing typically is delayed to effect higher combustion efficiency, fuel economy and good emission control.

Typically, such variable valve actuating mechanisms are hydraulically operated. The working fluid for operating the mechanism is typically provided by the lubrication system of the motor. The pressure of the working fluid is used to actuate various parts of the variable valve actuating mechanism.

SUMMARY OF THE INVENTION

One aspect of the present invention involves the recognition that the lubricant in the lubrication system typically contains vapors and/or bubbles. These vapors can adversely affect the operation of the variable valve actuating mechanism. For example, the vapors in the lubricant tend to rise. As such, the vapors tend to collect in the upper portions of lubricant passages. This can result in uneven flow of the lubricant, which can adversely effect the operation of the variable valve actuating mechanism.

As such, there is a need for an improved variable valve actuating mechanism that reduces the adverse effects of vapors in the working fluid. Such a mechanism should also be configured to minimize the number of parts, to reduce the size of the engine and to facilitate assembly and maintenance.

Therefore, one aspect of the present invention is an internal combustion engine for an outboard motor that comprises at least one combustion chamber formed by at least a engine body, a cylinder head assembly and a piston that moves relative to the engine body and the cylinder head assembly. A crankshaft extends in a generally vertical direction and is coupled to the piston such that movement of the piston causes the crankshaft to rotate. A port is in communication with the combustion chamber. A valve is moveable between open and closed positions of the port. A camshaft is journaled for rotation and extends generally parallel to the crankshaft. The camshaft includes at least one cam configured to open and close the valve. A rotor is attached an upper end of the camshaft and is positioned for at least partial rotation within a housing. The rotor defines at least a first space and a second space within said housing. A driven member is coupled to the housing. A drive member is coupled to an upper end of the output shaft. The drive member is coupled to the driven member such that rotation of the drive member is transmitted to the driven member. A control valve is positioned within a common hydraulic passage having a first opening and a second opening. A first hydraulic passage is in communication with the first space and the first opening and a second hydraulic passage in communication with the second space and second opening. The control valve is configured to selectively open and close the first and second openings such that hydraulic fluid is preferentially supplied to either the first space or the second space. The control valve is positioned generally along an axis that is perpendicular to the camshaft.

Another aspect of the present invention is an internal combustion engine for an outboard motor that comprises at least one combustion chamber formed by at least a engine body, a cylinder head assembly and a piston that moves relative to the engine body and the cylinder head assembly. A crankshaft extends in a generally vertical direction and is coupled to the piston such that movement of the piston causes the crankshaft to rotate. A port is in communication with the combustion chamber. A valve is moveable between open and closed positions of the port. A camshaft is journaled for rotation and extends generally parallel to the crankshaft. The camshaft includes at least one cam configured to open and close the valve. A rotor is attached an upper end of the camshaft and is positioned for at least partial rotation within a housing. The rotor defines at least a first space and a second space within said housing. A driven member is coupled to the housing. A drive member is coupled to an upper end of the output shaft. The drive member is coupled to the driven member such that rotation of the drive member is transmitted to the driven member. A control valve is positioned within a common hydraulic passage having a first opening and a second opening. A first hydraulic passage is in communication with the first space and the first opening and a second hydraulic passage in communication with the second space and second opening. The control valve is configured to selectively open and close the first and second openings such that hydraulic fluid is preferentially supplied to either the first space or the second space. The first and second openings are positioned generally at a common engine elevation.

Yet another aspect of the present invention is 37. An internal combustion engine for an outboard motor comprising an engine body, a piston movable relative to the engine body, a crankshaft that extends in a generally vertical direction and is journaled for rotation by the piston, the engine body, the piston and a cylinder head assembly together defining a combustion chamber, a port in communication with the combustion chamber, a valve movable between open and closed positions of the port, a camshaft that extends generally parallel to the crankshaft and is journaled for rotation to actuate the valve in a set angular position, a variable valve timing mechanism arranged to set the valve actuator to an angular position between a first angular position and a second angular portion, the first angular position being advanced as compared to the second angular position, the variable valve timing mechanism comprising a setting section, a supply section and a control section, the section comprising a control valve that is disposed on along an axis that is generally perpendicular to the camshaft.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise 13 figures.

DETAILED DESCRIPTION OF THE PREFERRED EMBODIMENTS OF THE INVENTION

FIGS. 1–4 illustrate an overall construction of an outboard motor 30 that employs an internal combustion engine 32 and a variable valve timing mechanism that are configured in accordance with certain features, aspects and advantages of the present invention. The engine and variable valve timing mechanism are described in the context of an outboard motor because the engine and variable valve timing mechanism have particular utility in this context. However, certain features, aspects and advantages of the present invention may find utility with other types of marine drives, land vehicles and/or stationary engines.

Figure 1:
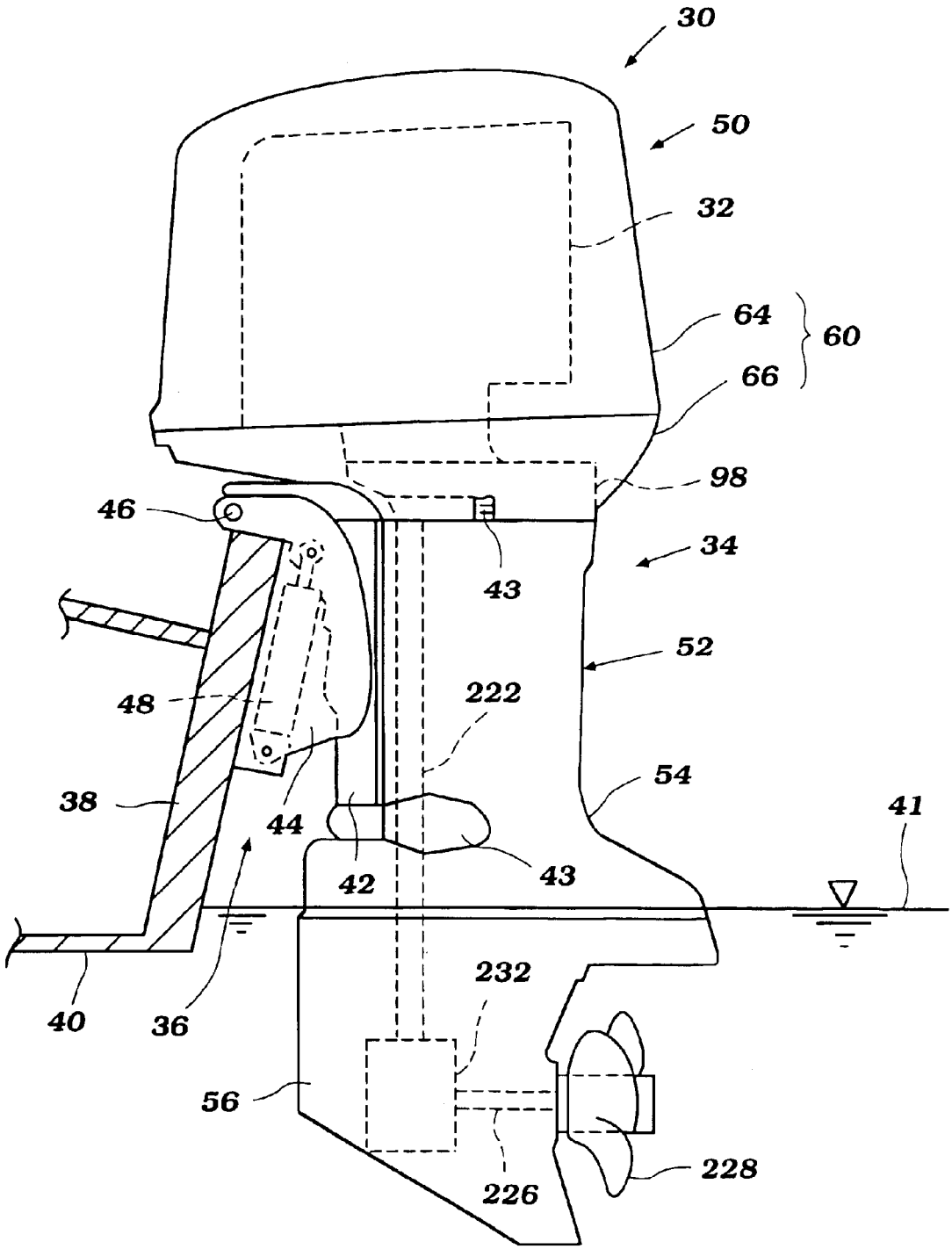
FIG. 1 is a side elevational view of an outboard motor having certain features and advantages according to the present invention.

With initial reference to FIG. 1, the illustrated outboard motor 30 comprises a drive unit 34 and a bracket assembly 36. The bracket assembly 36 supports the drive unit 34 on a transom 38 of an associated watercraft 40. With the watercraft 40 resting on the surface 41 of a body of water, the bracket assembly 36 is configured to place a marine propulsion device of the outboard motor 30 in a submerged position. The bracket assembly 36 preferably comprises a swivel bracket 42, a clamping bracket 44, a steering shaft (not shown) and a pivot pin 46.

The steering shaft typically extends through the swivel bracket 42 and is affixed to the drive unit 34 by top and bottom mount assemblies 43. The steering shaft is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward," "forwardly" and "front" mean at or to the side of the outboard motor where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system 48 preferably is provided between the swivel bracket 42 and the clamping bracket 44 to tilt the swivel bracket 42 and the drive unit 34 relative to the clamping bracket 44. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 50 and a housing unit 52, which includes a driveshaft housing 54 and a lower unit 56. The power head 50 is disposed atop the drive unit 34 and includes an internal combustion engine 32 that is positioned within a protective cowling 60 that preferably is made of plastic. Preferably, the protective cowling 60 defines a generally closed cavity 62 (see FIG. 2) in which the engine 32 is disposed. The protective cowling assembly 60 preferably comprises a top cowling member 64 and a bottom cowling member 66. In one arrangement, the top cowling member 64 is detachably affixed to the bottom cowling member 66 by a coupling mechanism so that a user, operator, mechanic or repair person can access the engine 32 for maintenance and/or for other purposes.

Figure 2:
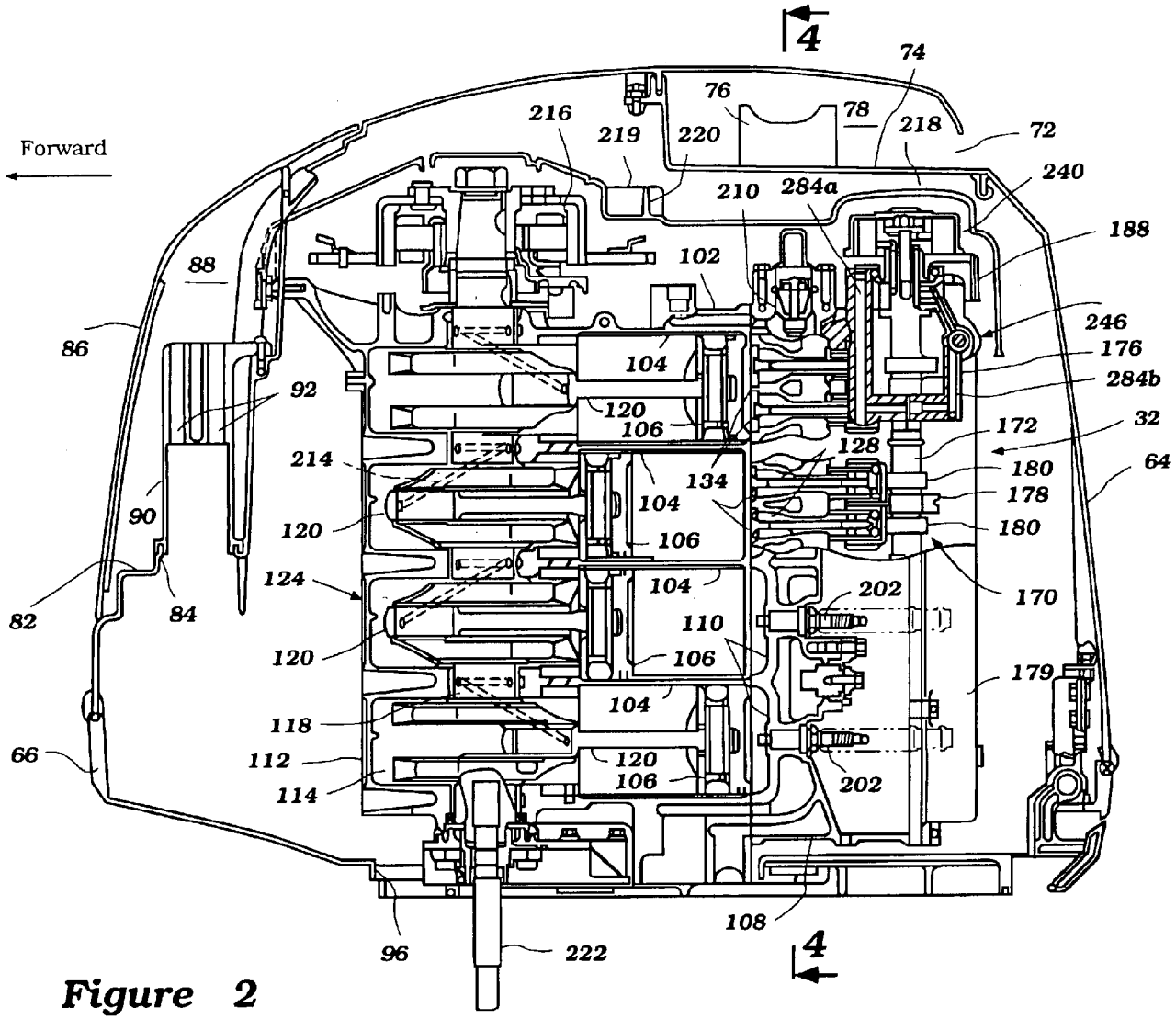
FIG. 2 is a sectional port side view of a power head of the outboard motor. An engine of the power head is also shown in section. A camshaft drive mechanism is omitted in this figure except for an intake driven sprocket.
Figure 4:
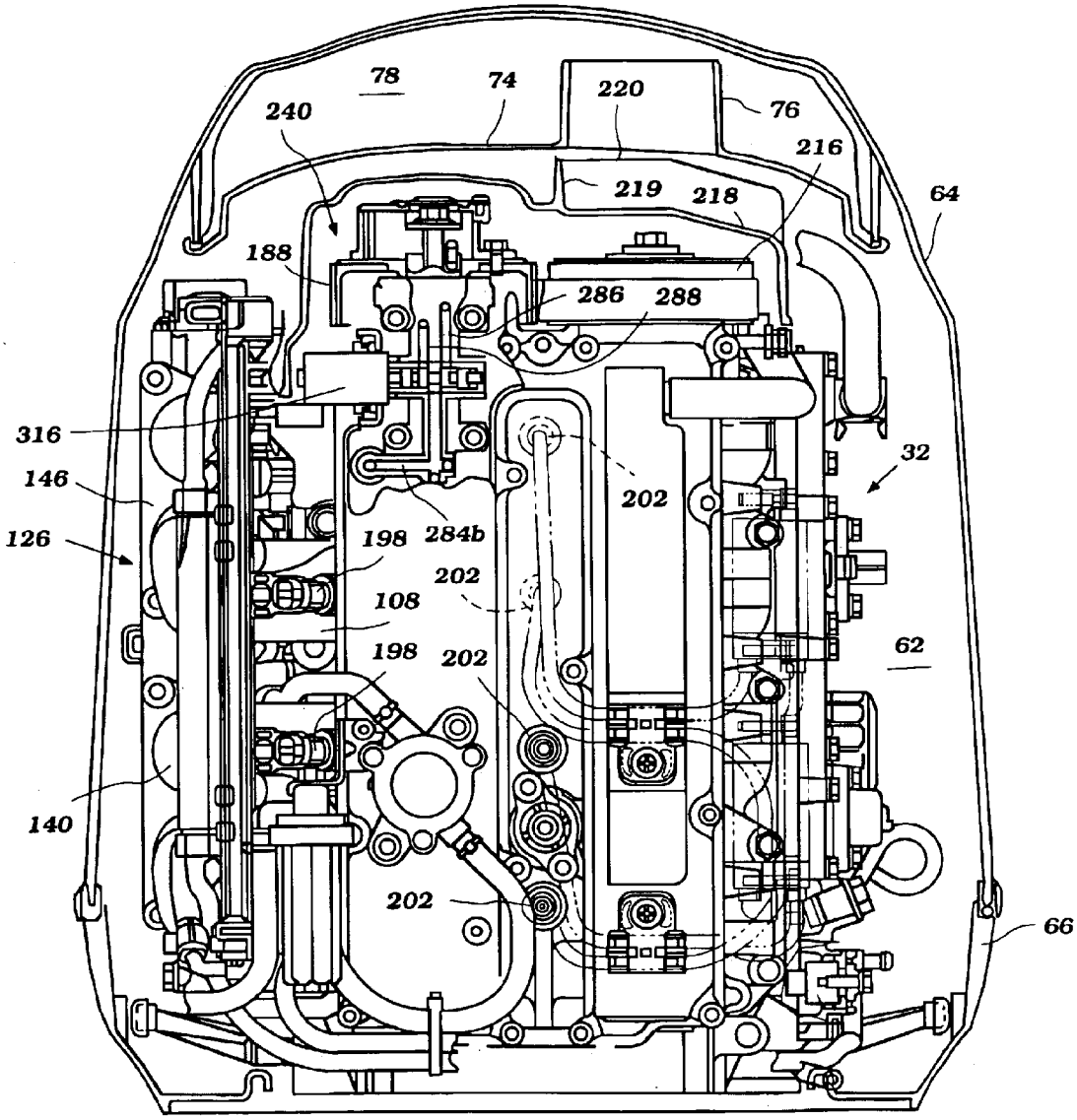
FIG. 4 is a rear view of the power head. The cowling assembly is shown in section taken along the line 4—4 of FIG. 2.

With particular reference to FIG. 2, the top cowling member 64 preferably has a rear intake opening 72 formed on its rear and top portion. A rear intake member 74 with a rear air duct 76 is affixed to the top cowling member 64 to form a rear air intake space 78 with the rear top portion of the top cowling member 64. As best seen in FIG. 4, the rear air duct 74 is disposed on the starboard side of the rear intake member 74.

With continued reference to FIG. 2, the top cowling member 64 defines a recessed portion 82 at a front end thereof. An opening 84 is defined proximate the recessed portion 82 on the starboard side. An outer shell 86 covers the recessed portion 82 to define a front air intake space 88. A front air duct 90 is affixed to the recessed portion 82 of the top cowling member 64 to be placed over the opening 84 and to communicate with the closed cavity 62. The air duct 90 has a plurality of apertures 92, each of which preferably is cylindrical. Ambient air thus is drawn into the closed cavity 62 through the rear intake openings 72 and then through the air duct 76 and front air duct 90. The top cowling member 64 also can taper in girth toward its top surface, which is in the general proximity of the air intake opening 72.

The bottom cowling member 66 preferably has an opening 96 at its bottom portion through which an upper portion of an exhaust guide member 98 (see FIG. 1) extends. The exhaust guide member 98 preferably is made of aluminum alloy and is affixed atop the driveshaft housing 54. The bottom cowling member 66 and the exhaust guide member 98 together generally form a tray. The engine 32 is placed onto this tray and is affixed to the exhaust guide member 98. The exhaust guide member 98 also has an exhaust passage through which burnt charges (e.g., exhaust gases) from the engine 32 are discharged.

Figure 3:
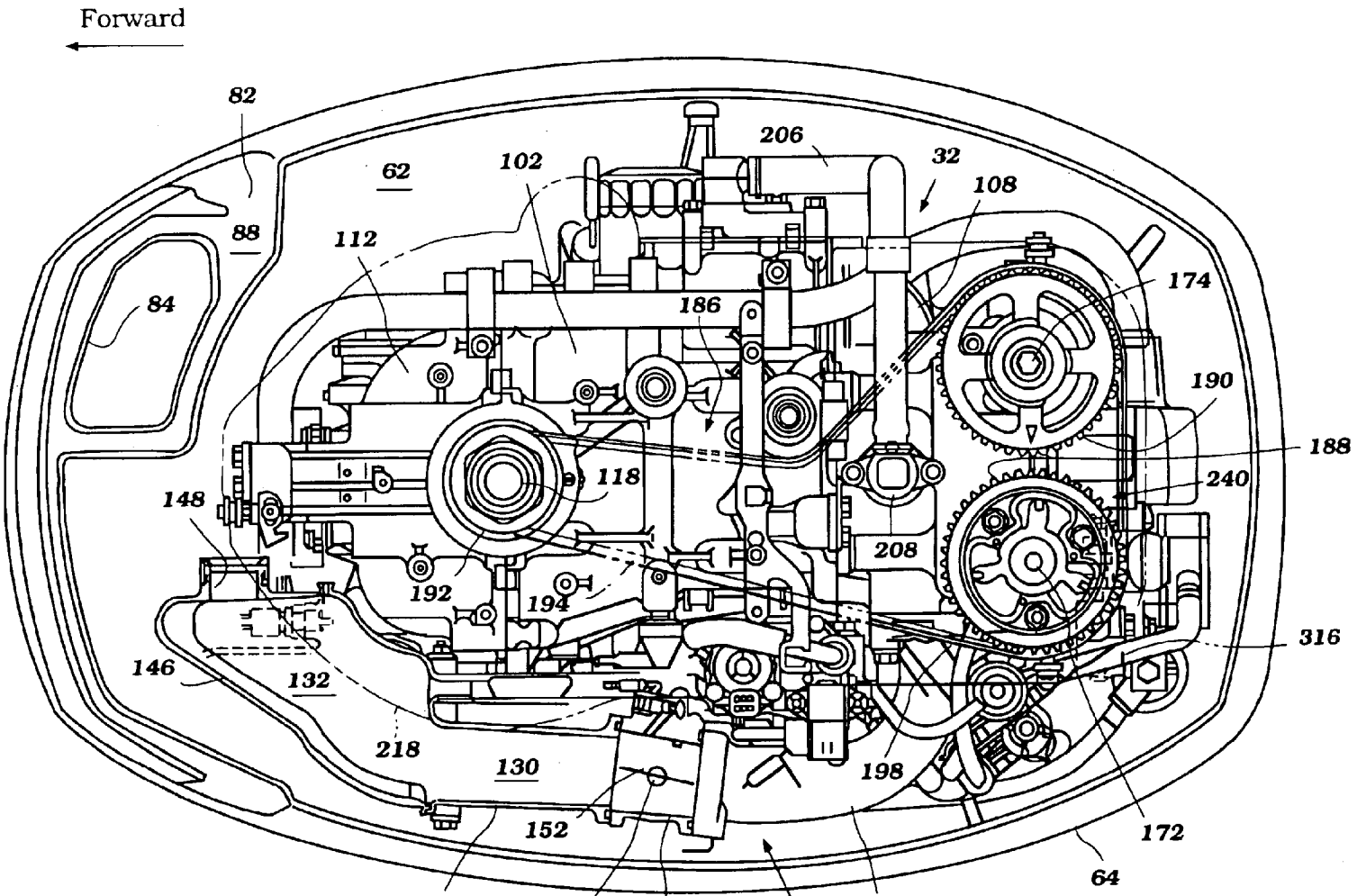
FIG. 3 is a top plan view of the power head.

The engine 32 in the illustrated embodiment preferably operates on a four-cycle combustion principle. With reference to FIG. 3, the engine 32 has a cylinder block 102. The illustrated cylinder block 102 defines four cylinder bores 104 which extend generally horizontally and are generally vertically spaced from one another. As used in this description, the term "horizontal" and "horizontally" mean that the subject portions, members or components extend generally parallel to the water line 41 when the associated watercraft 40 and the drive unit 34 are placed in the position shown in FIG. 1. The term "vertically" in turn means that portions, members or components extend generally normal to those that extend horizontally. It should be appreciated that the illustrated type of engine merely exemplifies one type of engine on which various aspects and features of the present invention can be suitably used. Engines having other number of cylinders, having other cylinder arrangements, and operating on other combustion principles (e.g., crankcase compression two-stroke or rotary) also can employ various features, aspects and advantages of the present invention.

A piston 106 is positioned for reciprocal movement in each cylinder bore 104, as is a well-known in the art. A cylinder head assembly 108 is affixed to one end of the cylinder block 102 for closing the cylinder bores 104. The cylinder head assembly 108 preferably defines four combustion chambers 110 together with the associated pistons 106 and cylinder bores 104. Of course, the number of combustion chambers can vary, as indicated above. A crankcase member 112 closes the other end of the cylinder bores 104 and defines a crankcase chamber 114 together with the cylinder block 102. A crankshaft or output shaft 118 extends generally vertically through the crankcase chamber 114 and is journaled for rotation by several bearing blocks in a suitable arrangement. Connecting rods 120 couple the crankshaft 118 with the respective pistons 106 in a well-known manner. Thus, the crankshaft 118 can rotate with the reciprocal movement of the pistons 106.

Preferably, the crankcase member 112 is located at the most forward position, with the cylinder block 102 and the cylinder head assembly 108 extending rearward from the crankcase member 112. Generally, the cylinder block 102, the cylinder head assembly 108 and the crankcase member 112 together define an engine body 124. Preferably, at least these major engine portions 102, 108, 112 are made of an aluminum alloy. The aluminum alloy advantageously increases strength over cast iron while decreasing the weight of the engine body 96.

With particular reference to FIGS. 2-5, the engine 32 further comprises an air induction system or device 126 for supplying air to the combustion chambers 110. The air induction system 126 draws the air from the cavity 62 to the combustion chambers 110. The air induction system 126 preferably comprises eight intake ports 128, four intake passages 130 and a single plenum chamber 132. In the illustrated arrangement, two intake ports 128 are allotted to one combustion chamber 110 and also to one intake passage 130. The intake ports 128 are defined in the cylinder head assembly 108. Intake valves 134 are slidably disposed at the cylinder head assembly 108 to move between an open position and a closed position. Bias springs 136 (FIG. 5) can be used to urge the intake valves 134 toward the respective closed positions and can be secured in position on the respective valve stems by retainers 138 that are affixed to the valves 134. When each intake valve 134 is in the open position, the intake passage 130 that is associated with the intake port 128 communicates with the associated combustion chamber 110.

Each intake passage 130 preferably is defined by an intake manifold 140, a throttle body 142 and an intake runner 144. The intake manifold 140 and the throttle body 142 preferably are made of aluminum alloy, while the intake runner 144 can be made of plastic. As best seen in FIG. 3, a portion of the intake runner 144 extends forwardly. The respective portions of the intake runners 144 define the plenum chamber 132 together with a plenum chamber member 146 that preferably is made of plastic. The plenum chamber 132 has an air inlet 148 such that air in the closed cavity 62 can be drawn into the plenum chamber 132 through the air inlet 148 before flowing through the respective intake passages 130. The plenum chamber 132 promotes uniform air flow between the intake passages 130 and acts as an intake silencer. The intake passage 130 (i.e., the intake manifold 140 or the intake runner 144) preferably includes an intake pressure sensor (not shown) to sense the pressure in the intake passage 130. Preferably, the respective intake passages 130 are similarly sized such that every passage 130 will operate at substantially equal pressure.

Each throttle body 142 has a throttle valve 152 journaled for pivotal movement about an axis of a valve shaft 154 that extends generally vertically. The valve shaft 154 links the all of the valves 152 to enable simultaneous valve movement. The valve shaft 154 is operable by the operator through an appropriate conventional throttle valve linkage. The throttle valves 152 are movable between an open position and a closed position to regulate the amount of air flowing through the air intake passages 130. Normally, the greater the opening degree, the higher the rate of airflow and the higher the engine speed. In order to bring and maintain idle speed, the throttle valves 152 are almost closed but preferably not completely closed to ensure a stable idle speed and to prevent sticking of the throttle valves 152. Preferably, a throttle position sensor (not shown) is disposed atop the valve shaft 154 to sense the position of the throttle valves 152.

The air induction system 126 preferably includes an idle air delivery device that bypasses the throttle valves 152 and extends from the plenum chamber 132 to the respective intake passages 130. Idle air thus may be delivered to the combustion chambers 110 through the idle air delivery device when the throttle valves 152 are substantially closed. The idle air delivery device preferably includes an idle air passage that is branched from the respective intake passages, an idle valve and an idle valve actuator. The idle valve preferably is a needle valve that can move between an open position and a closed position. The idle valve actuator actuates the idle valve to a certain position to adjust an amount of the idle air flowing into the combustion chambers.

The engine 32 also includes an exhaust system that routes burnt charges (i.e., exhaust gases) from the combustion chambers 110 to a location outside of the outboard motor 30. Each cylinder bore 104 preferably has two exhaust ports (not shown) defined in the cylinder head assembly 108. The exhaust ports are selectively opened and closed by exhaust valves. A structure of each exhaust valve and an arrangement of the exhaust valves are substantially the same as the intake valve and the arrangement thereof, respectively.

An exhaust manifold (not shown) preferably is formed next to the exhaust ports and extends generally vertically. The exhaust manifold communicates with the combustion chambers 110 through the exhaust ports to collect exhaust gases therefrom. The exhaust manifold is coupled with the foregoing exhaust passage of the exhaust guide member 98 (see FIG. 1). When the exhaust ports are opened, the combustion chambers 110 thus communicate with the exhaust passage through the exhaust manifold.

Figure 5:
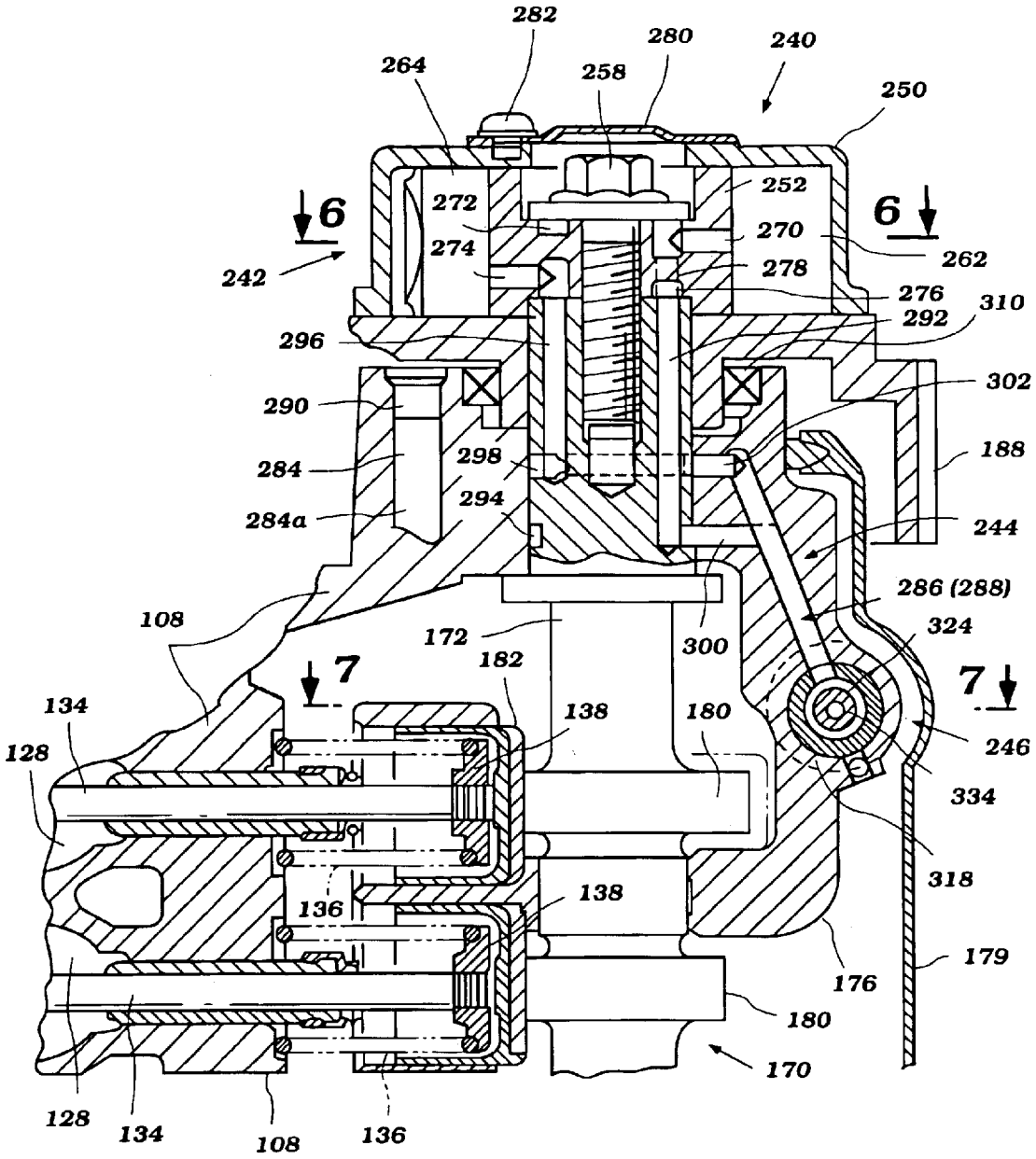
FIG. 5 is an enlarged, sectional side view of a portion of the engine that includes a variable valve timing (VVT) mechanism having certain features and advantages according to the present invention.

With particular reference to FIGS. 2, 3 and 5, a valve cam mechanism or valve actuator 170 preferably is provided for actuating the intake valves 134 and the exhaust valves. In the illustrated embodiment, the valve cam mechanism 170 includes an intake camshaft 172 and an exhaust camshaft 174 that extend generally vertically. The camshafts 174 are journaled for rotation by the cylinder head assembly 108 and an upper bearing cap 176 and a lower bearing cap 178. Preferably, at least the upper bearing cap 176 is formed by a single integral member, which supports the intake and the exhaust cam shafts 172, 174. A camshaft cover 179 is affixed to the cylinder head assembly 108 to cover the camshafts 172, 174. As best seen in FIG. 5, each camshaft 172, 174 has cam lobes 180 to push valve lifters 182 that are affixed to the respective ends of the intake valves 134 and exhaust valves. The cam lobes 180 repeatedly push the valve lifters 182 at timing that is in proportion to the engine speed with the rotation of the camshafts 172, 174 to actuate the intake valves 134 and the exhaust valves. A method for controlling the timing will be described below.

A camshaft drive mechanism 186 is provided for driving the valve cam mechanism 170. As best seen in FIG. 3, an intake driven sprocket 188 is positioned atop the intake camshaft 172 and an exhaust driven sprocket 190 is positioned atop the exhaust camshaft 174. A drive sprocket 192 is also positioned atop the crankshaft 118. A timing chain or belt 194 is wound around the driven sprockets 188, 190 and the drive sprocket 192. The crankshaft 118 thus drives the respective camshafts 172, 174 through the timing chain 194 in a timed relationship. In other words, the sprockets 188, 190, 192 are all connected such that the sprockets 188, 190, 192 rotate in a generally fixed relationship with each other. Because the camshafts 172, 174 generally rotate at half of the speed of the rotation of the crankshaft 118 in the four-cycle combustion principle, the diameter of the driven sprockets 188, 190 is preferably twice as large as a diameter of the drive sprocket 192.

The engine 32 preferably has a port or manifold fuel injection system. The fuel injection system preferably comprises four fuel injectors 198 (see FIG. 4) with one fuel injector allotted for each of the respective combustion chambers 110. Each fuel injector 198 preferably has an injection nozzle directed toward the associated intake passage 130 adjacent to the intake ports 134. The fuel injectors 198 spray fuel into the intake passages 130 under control of an electronic control unit (ECU) that preferably is mounted on the engine body 124 at an appropriate location. The ECU controls the timing and duration of injection by the fuel injectors 198 so that the nozzles spray a proper amount of the fuel per combustion cycle. Of course, the fuel injectors 198 can be disposed for direct cylinder injection and carburetors can replace or accompany the fuel injectors 198.

The engine 32 further comprises an ignition or firing system. Each combustion chamber 110 is provided with a spark plug 202 that is connected to the ECU through an igniter such that ignition timing is also controlled by the ECU. Each spark plug 202 has electrodes that are exposed to the associated combustion chamber and are spaced apart from each other with a small gap. As is well known, the spark plugs 202 make a spark between the electrodes to ignite an air/fuel charge in the combustion chamber 110 at selected ignition timing under control of the ECU. In some arrangements, glow plugs can be used.

In the illustrated engine 32, the pistons 106 reciprocate between top dead center and bottom dead center. When the crankshaft 118 makes two rotations, the pistons 106 generally move from top dead center to bottom dead center (the intake stroke), from bottom dead center to top dead center (the compression stroke), from top dead center to bottom dead center (the power stroke) and from bottom dead center to top dead center (the exhaust stroke). During the four strokes of the pistons 106, the camshafts 172, 174 make one rotation and actuate the intake valves 134 and the exhaust valves to open the intake ports 128 during the intake stroke and to open exhaust ports during the exhaust stroke, respectively. Of course, other engine operating cycles also can be used.

Generally, at the beginning of the intake stroke, air is drawn through the air intake passages 130 and fuel is injected into the intake passages 130 by the fuel injectors 198. The air and the fuel thus are mixed to form the air/fuel charge in the combustion chambers 110. Slightly before or during the power stroke, the respective spark plugs 202 ignite the compressed air/fuel charge in the respective combustion chambers 110. The engine 32 thus continuously repeats the four-cycle combustion process.

During engine operation, heat builds in the engine body 124. The engine 32 thus includes a cooling system to cool the engine body 124. The outboard motor 30 preferably employs an open-loop type water cooling system that introduces cooling water from the body of water surrounding the motor 30 and then discharges the water to the water body. The cooling system includes one or more water jackets defined within the engine body 124 through which the introduced water runs to absorb heat from the engine body 124. As best seen in FIG. 3, the cooling system preferably includes a water discharge pipe 206 that extends from an outer surface of the engine body 124. A thermostat chamber 208 is defined at a location where the discharge pipe 206 is connected to the engine body 124 to enclose a thermostant 210 (FIG. 2) that controls flow of the discharged cooling water. When water temperature is relatively low (e.g., immediately after the engine 32 is started up), the thermostat 210 inhibits the water from flowing out so that the engine 32 can be warmed up quickly.

The engine 32 also preferably includes a lubrication system. Although any type of lubrication systems can be applied, a closed-loop type system is employed in the illustrated embodiment. The lubrication system comprises a lubricant tank defining a reservoir cavity preferably positioned within the driveshaft housing 54. An oil pump is provided at a desired location, such as atop the driveshaft housing 54, to pressurize the lubricant oil in the reservoir cavity and to pass the lubricant oil through a suction pipe toward desired engine portions through lubricant delivery passages. The engine portions that receive lubrication include, for example, the crankshaft bearings, the connecting rods 120 and the pistons 106. Portions 214 of the delivery passages (FIG. 2) can be defined in the crankshaft 118. Lubricant return passages also are provided to return the oil to the lubricant tank for re-circulation.

With reference to FIGS. 2 and 4, a flywheel assembly 216 preferably is positioned above atop the crankshaft 118 and is mounted for rotation with the crankshaft 118. The flywheel assembly 216 preferably comprises a flywheel magneto or AC generator that supplies electric power to various electrical components, such as the fuel injection system, the ignition system and the ECU. A protective cover 218 extends over a majority of the top portion of the engine 32 to cover the portion including the fly wheel assembly 216 and the camshaft drive mechanism 186. The protective cover 218 preferably has a rib 219 (FIG. 4) that prevents air from flowing directly toward the portion of the engine 32 that has the air induction system 126 (i.e., the starboard side of the engine 32). The protective cover 218 also preferably has a second rib 220 (FIG. 2) that inhibits the air from flowing directly toward a front portion of the engine body 124. The ribs 219, 222 advantageously form an air flow path that moves around the engine body 124 in a manner that can also cool the engine body 124.

With reference again to FIG. 1, the driveshaft housing 54 depends from the power head 50 to support a driveshaft 222 which is coupled with the crankshaft 118 and which extends generally vertically through the driveshaft housing 54. The driveshaft housing 54 preferably defines an internal section (not shown) of the exhaust system that leads the majority of exhaust gases to the lower unit 56. Preferably, an idle discharge section (not shown) is branched off from the internal section to discharge idle exhaust gases directly out to the atmosphere through a discharge port (not shown) that is formed on a rear surface of the driveshaft housing 54.

The lower unit 56 depends from the driveshaft housing 54 and supports a propulsion shaft 226 that is driven by the driveshaft 222. The propulsion shaft 226 extends generally horizontally through the lower unit 56 and is journaled for rotation. A propulsion device is attached to the propulsion shaft 226. In the illustrated arrangement, the propulsion device is a propeller 228 that is affixed to an outer end of the propulsion shaft 226. The propulsion device, however, can take the form of a dual counter-rotating system, a hydrodynamic jet, or any of a number of other suitable propulsion devices.

A transmission 232 preferably is provided between the driveshaft 222 and the propulsion shaft 226, which lie generally normal to each other (i.e., at a 90° angle). The transmission 232 couples together the two shafts 222, 226 with bevel gears, as is well known in the art. The outboard motor 30 preferably has a switchover or clutch mechanism that allows the transmission 232 to change the rotational direction of the propeller 228 among forward, neutral or reverse.

With general reference to FIGS. 2–4 and with particular reference to FIGS. 5–7, a variable valve timing mechanism (herein "VVT mechanism") 240 having certain aspects, features and advantages according to the present invention will now be described.

The VVT mechanism 240 preferably is configured to set the intake camshaft 172 to an angular position that is between a first angular position and a second angular position with respect to the intake driven sprocket 188. At the first angular position, the intake camshaft 172 opens and closes the intake valves 134 at the most advanced timing. At the second angular position, the intake camshaft 172 opens and closes the intake valves 134 at the most delayed timing. Any angular position between both the first and second angular position is delayed with respect to the first angular position and is advanced with respect to the second angular position.

The VVT mechanism 240 preferably is hydraulically operated. As best seen in FIG. 5, the illustrated VVT mechanism 240 comprises a setting section 242, a fluid supply section 244 and a control section 246. As will be explained in more detail below, the setting section 242 sets the intake camshaft 172 at a certain angular position with respect to the intake driven sprocket 188 in response to a rate of working fluid flow that is allotted to each of two spaces of the setting section 242. The fluid supply section 244 preferably supplies the working fluid to the setting section 242. Preferably, the working fluid is a portion of the lubricant from the lubrication system. Of course in some arrangements, a separate hydraulic circuit can be formed. In such arrangements, a separate pump can be used. The control section 246 selects the amount of the working fluid allotted to each of the two spaces and preferably is under the control of the ECU.

Figure 6:
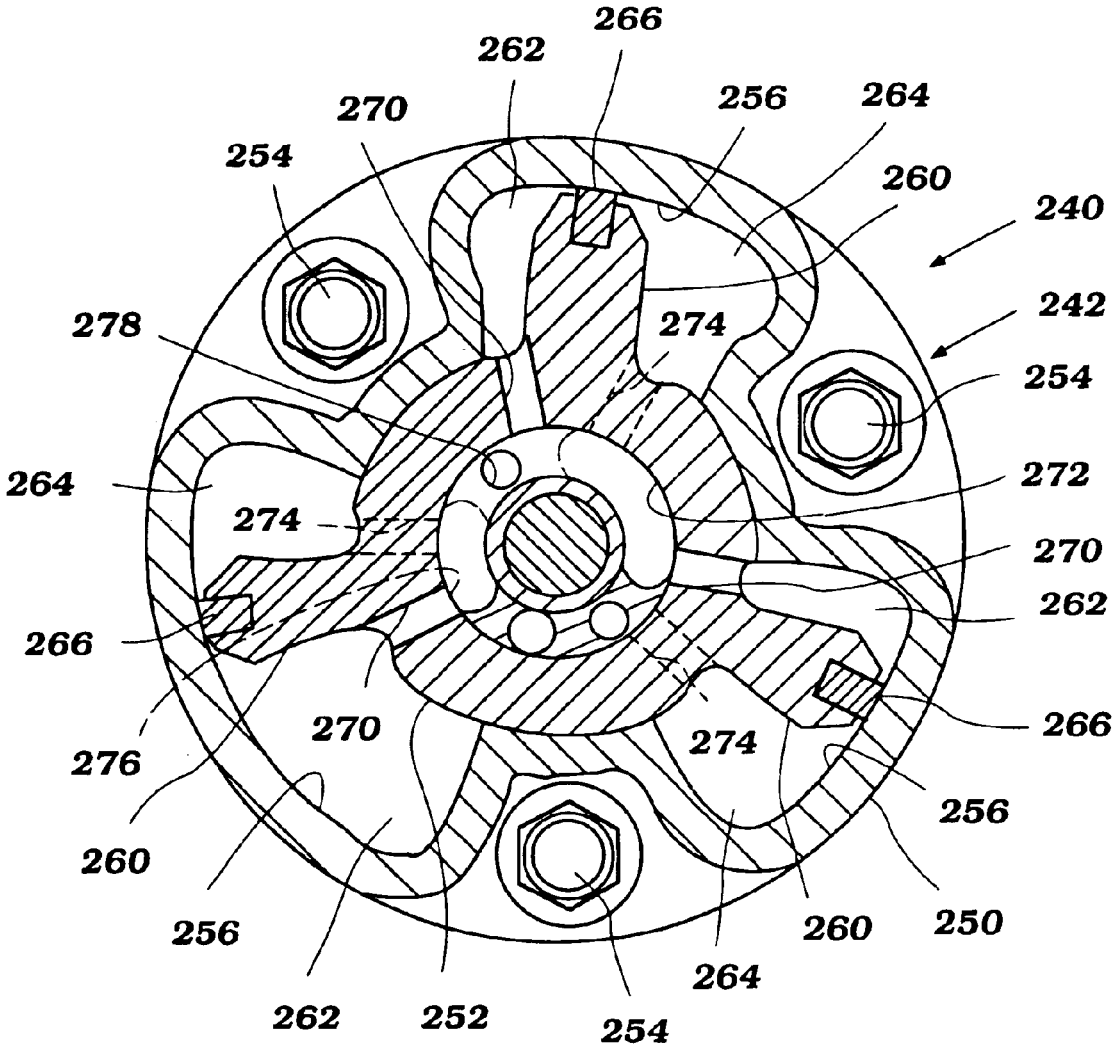
FIG. 6 is a cross-sectional view of the VVT mechanism taken along the line 6—6 of FIG. 5.

With particular reference to FIGS. 5 and 6, the setting mechanism 242 preferably includes an outer housing 250 and an inner rotor 252. The illustrated outer housing 250 is affixed to the intake driven sprocket 188 by three bolts 254 and preferably forms at least one chamber 256 and more preferably three chambers 256, which can be positioned between the three bolts 254. The inner rotor 252 is affixed atop of the intake camshaft 172 by a bolt 258 and preferably has at least one vane 260 pivotably placed within each of the respective chambers 256 of the housing 250. In the illustrated arrangement, the inner rotor 252 has three vanes 260 that extend radially and are spaced apart from each other by angle of approximately 120 degrees. The sides of each vane 260 divide the respective chambers 256 such that define a first space 262 and a second space 264. Seal members 266 preferably are carried by the respective vanes 260 and abut on an inner surface of the housing 250 so as to substantially separate the first and second spaces 262, 264 from each other.

The respective first spaces 262 communicate with one another through respective pathways 270 and a ditch 272 that is formed around the bolt 258, while the respective second spaces 264 communicate with one another through respective pathways 274 and a ditch 276 that is also formed around the bolt 258. The ditches 272, 276 in the illustrated arrangement generally are configured as a substantially circular flow path around the bolt and are axially offset from one another. A pathway 278 extends from the ditch 272 to a bottom portion of the rotor 252. A cover member 280 is affixed to the outer housing 250 by screws 282 to cover the bolt 258.

Figure 7:
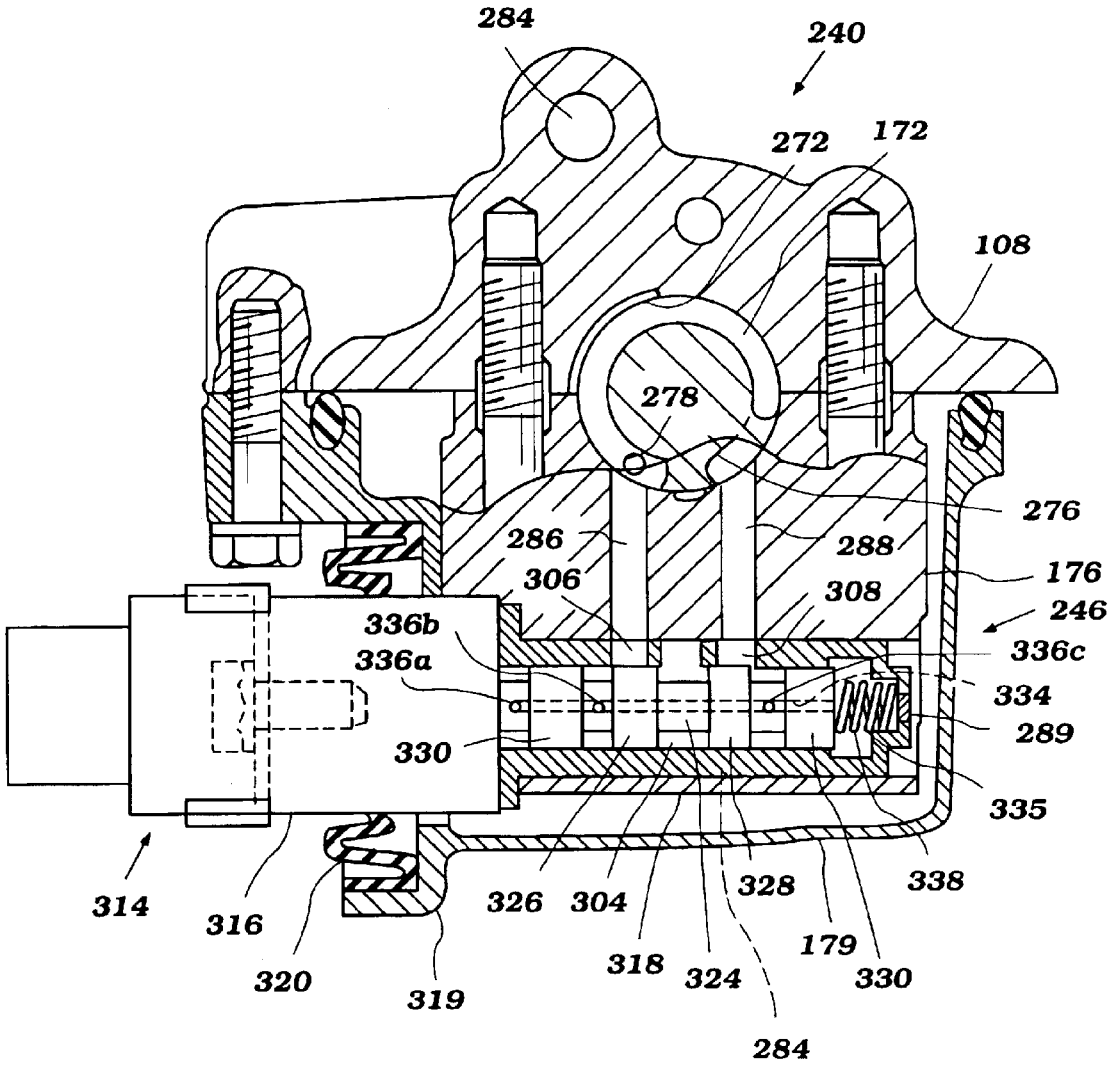
FIG. 7 is a cross-sectional view of the VVT mechanism taken along the line 7—7 of FIG. 5

With particular reference to FIGS. 5 and 7, the fluid supply section 244 preferably includes a supply passage 284 (see also FIG. 2) and a first and second passages 286, 288. The supply passage 284 and the first and second passages 286, 288 communicate with one another through the control section 246. The supply passage 284 preferably has a passage portion 284*a* (FIG. 5) defined in the cylinder head assembly 108 and a passage portion 284*b* (FIG. 2) defined in the bearing cap 176.

The supply passage 284 communicates with the lubrication system so that a portion of the lubricant is supplied to this VVT mechanism 240. Because the illustrated passage portion 284*a* is formed by a drilling process in the illustrated embodiment, a closure member 290 closes one end of the passage portion 284*a*.

The first and second passages 286, 288 preferably are defined in a top portion of the camshaft 172 and the upper bearing cap 176. A portion of the first passage 286 is formed in the camshaft 172 and includes a pathway 292 that extends vertically and communicates with the pathway 278 that communicates with the ditch 272 of the first space 262. The ditch 294 advantageously places the pathway 292 in fluid communication with a pathway 300 regardless of the angular orientation of the camshaft 172. A portion of the second passage 288 formed in the camshaft 172, in turn, includes a pathway 296 that extends vertically and communicates with the ditch 274 of the second space 264. As shown in FIG. 5, a portion of the first delivery passage 286 formed in the bearing cap 176 includes a pathway 300 that extends generally vertically and horizontally and communicates with the ditch 294, while a portion of the second delivery passage 288 formed in the bearing cap 176 includes a pathway 302 that extends generally vertically and horizontally and communicates with the ditch 298. The inlet ends of the pathways first and second delivery passages 286, 288 selectively communicate with a common chamber 304 of the control section 246 through a first inlet port 306 and a second inlet port 308, respectively.

A seal member 310 is inserted between the cylinder head assembly 108, the camshaft 172 and the bearing cap 176 to inhibit the lubricant from leaking out. It should be noted that FIGS. 5 and 7 show the delivery passages 286, 288 in a schematic fashion and that the passages 286, 288 preferably do not actually merge together.

The control section 246 preferably includes an oil control valve (OCV) 314. The OCV 314 comprises a housing section 316 and a cylinder section 318. Both the housing and cylinder sections 316, 318 preferably are positioned in the upper bearing cap 176. The sections 316, 318 preferably also extend through a hole of the camshaft cover 179. The camshaft cover preferably 179 includes a lip 319 around the opening. A bellow 320, preferably made of rubber, is provided between the housing section 316 and the lip 319 of the camshaft cover 179 to close and seal the through-hole.

The cylinder section 318 defines the common chamber 304 that communicates the supply passage 284 and the first and second delivery passages 286, 288. The cylinder section preferably includes a drain 289 that, in the illustrated arrangement, is open to the interior of the camshaft cover 179 although in other arrangements the drain 289 can be connected to other portions of the lubrication system. The housing section 316 preferably encloses a solenoid type actuator, although other types of actuators can also be used.

A rod 324 extends into the common chamber 304 from the housing 316 and is axially movable therein. The illustrated rod 324 has a first valve 326 and a second valve 328 and a pair of guide portions 330. The valves 326, 328 and the guide portions 330 have an outer diameter that is larger than an outer diameter of the rod 324 and approximately equal to an inner diameter of the cylinder 318. The rod 324 defines an internal passage 334, which extends through the rod 324, and apertures 336*a*, 336*b*, 336*c*, which communicate with the passage 334 and the common chamber 304 to allow the lubricant to escape through the drain 289 through an opening 335 as will be explained in more detail below. A coil spring 338 is retained at an end of the cylinder 318 opposite to the housing section 316 to urge the rod 324 toward the solenoid.

The solenoid actuates the rod 324 under control of the ECU so that the rod 324 can take several axial positions in the chamber 304. More specifically, the solenoid is configured to preferably push the rod 324 step by step toward certain positions as the ECU commands. If the desired position is closer to the solenoid than the present position, then the solenoid does have to actuate the rod 324 and the coil spring 338 cam push the rod 324 back to the desired position.

To direct lubricant to the first space 262, the rod 324 is moved to the left of the position shown in FIG. 7. In this position, the first passage 286 is in communication with the supply passage 284 while the second valve 328 substantially isolates the second passage 288 from the supply passage 284. In this manner, lubricant can flow into the first space 262 while the lubricant in the second space 264 can escape to the drain 289. For example, in the illustrated arrangement, the lubricant in the second passage 288 can flow into the aperture 336*c* through passage 334 and to the drain 289. To direct lubricant to the second space 264, the rod 324 is moved to the right from the position shown in FIG. 7. In this position, the second passage 288 is in communication with the supply passage 284 while the first valve 326 substantially isolates the first passage 286 from the supply passage 284. In this manner, lubricant can flow into the second space 264 while the lubricant in the first space 262 can escape through the drain 289. That is, the lubricant in the first passage 286 can flow into the aperture 336*b* and through passage 334 into the drain 289. In a "neutral" position, which is illustrated in FIG. 7, the first and second valves 326, 328 cover the first and second passages 286, 288. As such, in this position, the lubricant in the first and second spaces 262 cannot escape and the position of the inner rotor 252 is fixed.

In the manner described above, the degree to which the inlet ports 306, 308 are closed or opened determines the amount of the lubricant that is allotted to the first and second passages 286, 288 and to the first and second spaces 262, 264 in the setting section 242 described above. The amount of the lubricant supplied to the first and second spaces 262, 264 thus determines an angular position of the camshaft 172 with respect to the intake driven sprocket 188. If more lubricant is allotted to the first space 262 than to the second space 264, the camshaft 172 is set closer to the most advanced position, and vise versa.

The operation of the illustrated VVT mechanism 240 will now be described in more detail. When the engine 32 is running, the rotation of the crankshaft 118 is transmitted to the exhaust camshaft 174 through the exhaust driven sprocket 190 and the timing chain 194. In a similar manner, the rotation of the crankshaft is also transmitted to the intake camshaft 172 through the timing chain 194, intake driven sprocket 188 and the VVT mechanism 240. Preferably, the intake and exhaust camshafts 172, 174 rotate at a predetermined speed (e.g., one half of the speed of the crankshaft 118).

As mentioned above, the outer housing 250 of the VVT mechanism 240 is coupled to and thus rotated by the intake driven sprocket 188. The rotation of outer housing 250 is transmitted to the inner rotor 252 through the lubricant in the chambers 256 of the housing 250. The inner rotor 252, in turn, is affixed to atop the intake camshaft 172 such that the rotation of the inner rotor 252 is transmitted to the intake camshaft 172. When the intake camshaft 172 is rotated, the intake valves 134 are opened and closed at an appropriate timing by the intake cams 180 formed in the intake camshaft 172. Therefore, by selectively supplying lubricant to the first and second spaces 262, 264 inside the VVT mechanism 240, the phase of the intake camshaft 172 with respect to the intake driven sprocket 188 can be adjusted and, thus, the timing of the opening and closing of the intake valves 134 can be controlled.

The control section 246 selectively supplies and removes lubricant to/from the first and second spaces 262, 264 as described above. Lubricant is supplied from the lubricant pump or an additional pump to the common chamber 304 of the control section 246 through the lubricant passages 284. From the common chamber 304, the lubricant is selectively supplied to the delivery passages 286, 288, by alternately opening and closing or by partially blocking the inlet ports 306, 308 with the rod 324 of the OCV 314. As mentioned above, the ECU controls the movement of the rod 324.

When the lubricant is supplied to the first delivery passage 286, lubricant is supplied to the first space 262 through the lubricant passages 292, 278, 270, lubricant is removed from the second space 264 and the inner rotor 252 rotates to the clockwise direction relative to the outer housing 250 as shown in FIG. 6. When lubricant is supplied to the second delivery passage 288, lubricant is supplied to the second space 264 through the lubricant passages 298, 296 274 and lubricant is removed from the first space as described above. The inner rotor 252 rotates relative to the outer housing 250 in the counterclockwise direction as shown in FIG. 6. As such, the phase of the intake camshaft 172 which rotates together with the inner rotor 252 can be adjusted and the opening-and-closing timing of the intake valves 134 can be advanced or delayed. To set the inner rotor 252 at a particular position, the first and second passages 286, 288 are closed by the first and second valves 326, 328 as shown in FIG. 7.

An advantage of the illustrate arrangement is that the since the OCV 314 is generally positioned along a substantially horizontal axis, which in the illustrated arrangement, is also generally perpendicular to the intake camshaft 172. This arrangement is advantageous for several reasons. For example, the lubricant in the lubricant system may have vapors (i.e., bubbles) mixed into the lubricant. As mentioned above, if the OCV 314 is positioned along a substantially vertical axis, these vapors can tend to rise and can be preferentially directed to one of the two supply passages 286, 288. This can alter the amount of lubricant that is supplied to the first and second spaces 262, 264, which in turn, can cause inaccuracies in the phase angle of the inner rotor 252 with respect to the outer housing 250 and the timing of the opening and closing of the intake valves 134. By arranging the common chamber and such that the inlet ports 306, 308 are located substantially at the same elevation, the lubricant supplied to the first and second spaces 262, 264 is more consistent as the vapors are not preferentially directed to either the first or the second passages 286, 288.

Another advantage of the illustrated arrangement is that, in the illustrated arrangement, the OCV 314 is positioned near the upper end of the intake camshaft 172. More preferably, the OCV 313 is positioned in the upper bearing cap 176, which supports the intake camshaft 172 and, in the illustrated arrangement, the exhaust cam shaft 174. This position reduces the distance between the OCV 314 and the setting section 242, which is located atop the intake cam shaft 172. As such, the length of the various lubricant passages, which preferably are also located in the upper bearing cap 176, of the fluid supply section 244 can be reduced. The shortened distances increases the responsiveness of the VVT 240 to the position changes of the OCV 314.

Another advantage of the illustrated arrangement is that the OCV 314 positioned generally along an axis that extends across the engine 32 from the right side to the left side. This provides for a compact size of the engine 32.

It should be appreciated that, although in the illustrated arrangement the VVT 240 is provided for the intake valves 134, in a modified arrangement a VVT 240 of a similar arrangement can be provided instead, or in addition, for the exhaust valves.

Figure 8:
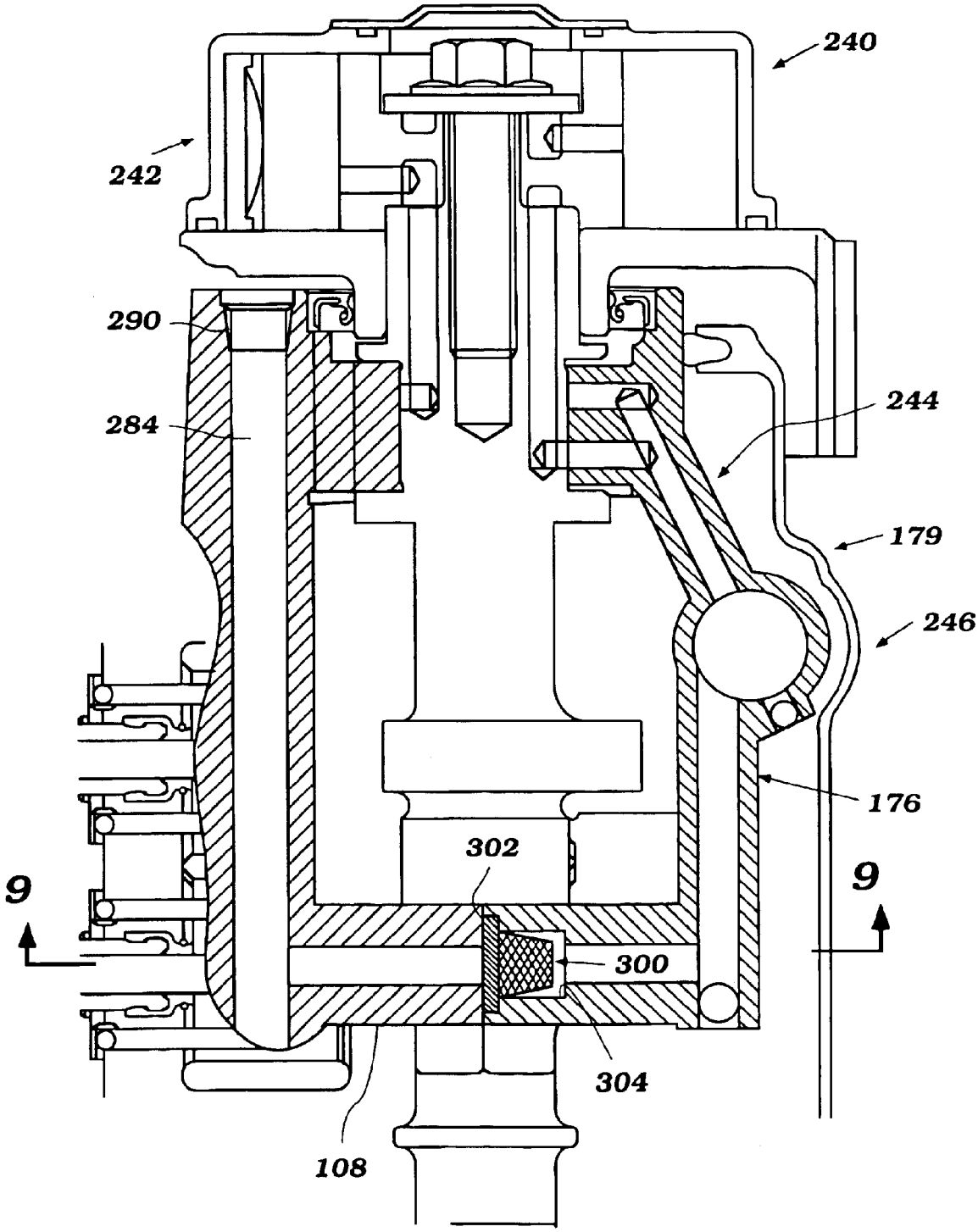
FIG. 8 is an enlarged, sectional side view of another arrangement of a variable valve timing (VVT) mechanism having certain features and advantages according to the present invention.
Figure 9:
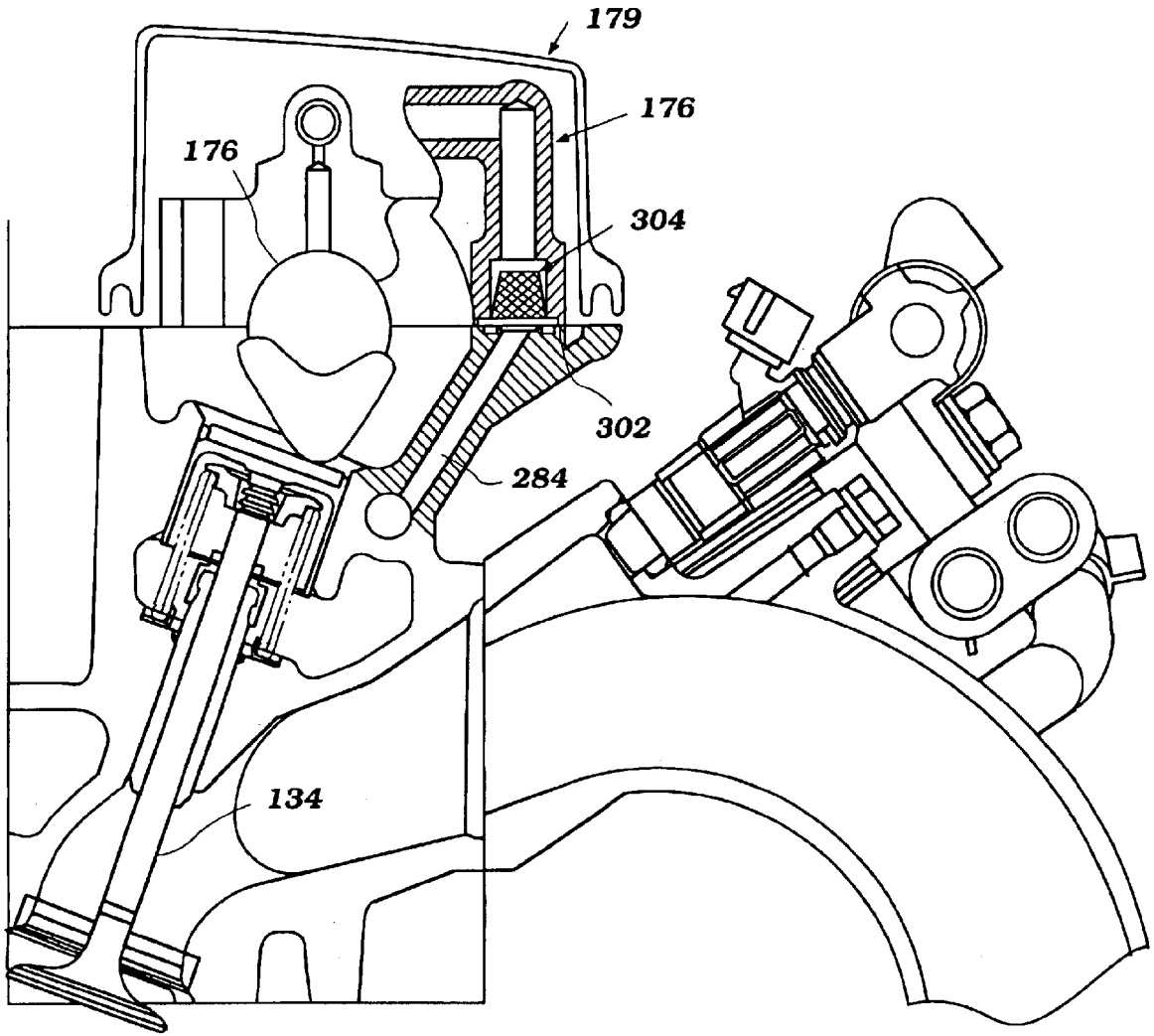
FIG. 9 is a cross-sectional view of the VVT mechanism of FIG. 8 taken along line 9—9 of FIG. 8.

FIGS. 8 and 9 illustrate a modified arrangement of the VVT 240 having certain features and advantages according to the present invention. In this arrangement, the VVT 240 includes a lubricant filter 300. The lubricant filter 300 preferably is located on a contact face 302 between the upper bearing cap 176 and the cylinder head assembly 108. More specifically, a lubricant filter bore 304 is provided in the supply passage 284 for supporting the filter 300. The bore 304 has an opening on the contact face 302.

An advantage of this arrangement is that it provides for a simplified assembly. For example, the filter 300 can be inserted into the bore 304 and then the upper bearing cap can coupled to the cylinder head assembly 108. In a similar manner, the filter can be easily replaced or checked by uncoupling the cylinder head assembly 108 and the upper bearing cap 176 to expose the filter 300. It should be appreciated that in a modified arrangement, the bore can be positioned in the cylinder head assembly such that the filter is positioned in the cylinder head assembly. In such an arrangement, the bore would have an opening on the contact face of the cylinder head assembly.

Of course, the foregoing description is that of a preferred construction having certain features, aspects and advantages in accordance with the present invention. Various changes, combinations, sub-combinations and modifications may be made to the above-described arrangements without departing from the spirit and scope of the invention, as defined by the appended claims.

What is claimed is:

1. An internal combustion engine for an outboard motor comprising an engine body, a piston movable relative to the engine body, a crankshaft that extends in a generally vertical direction and is journaled for rotation by the piston, the engine body, the piston and a cylinder head assembly together defining a combustion chamber, a port in communication with the combustion chamber, a valve movable between open and closed positions of the port, a camshaft that extends generally parallel to the crankshaft and is journaled for rotation to actuate the valve in a set angular position, a variable valve timing mechanism arranged to set the camshaft to an angular position between a first angular position and a second angular portion, the first angular position being advanced as compared to the second angular position, the variable valve timing mechanism comprising a setting section-, a supply section and a control section, the control section comprising a control valve that is disposed on along an axis that is generally perpendicular to the camshaft, the supply section comprising a first hydraulic passage and a second hydraulic passage that are in hydraulic communication with the setting section and the control section, the first hydraulic passage and the second hydraulic passage not extending below a generally horizontal plane that lies normal to the axis of the camshaft and that contains a central axis that extends through the control valve, wherein the valve is positioned below the generally horizontal plane and the setting section is positioned above the generally horizontal plane.

2. An engine as in claim 1, wherein the control valve is also positioned generally along an axis that extends transversely across the engine.

3. An engine as in claim 1, wherein the control valve is positioned near an upper end of the camshaft.

4. An engine as in claim 1, further comprising a bearing cap located near an upper end of the camshaft, the bearing cap configured to cooperate with the cylinder head assembly so as to support the camshaft for rotation.

5. An engine as in claim 4, wherein at least a portion of the first hydraulic passage and second hydraulic passage are formed in the bearing cap.

6. An engine as in claim 5, wherein the port is an intake port, the valve is an intake valve, and the camshaft is an intake camshaft.

7. An engine as in claim 6, further comprising an exhaust port, an exhaust valve and an exhaust camshaft that extends generally parallel to the intake camshaft, wherein the bearing cap is also configured to cooperate with the cylinder head assembly to support the exhaust camshaft for rotation, the bearing cap having a single integral body.

8. An engine as in claim 4, further comprising a cylinder head cover and wherein the control valve extends through an opening in the cylinder head cover.

9. An engine as in claim 8, wherein the opening in the head cover includes a lip and a sealing member positioned between the lip and the control valve.

10. An engine as in claim 1, further comprising a lubrication system and lubrication passages, the lubrication passages including a supply passage that is in communication with the control section.

11. An engine as in claim 10, wherein the supply passage is defined, at least in part, in the cylinder head assembly.

12. An engine as in claim 1, wherein the port in an intake port, the valve is an intake valve and the camshaft is an intake camshaft.

13. An engine as in claim 1, wherein the port is an exhaust port, the valve in an exhaust valve and the camshaft is an exhaust camshaft.

14. An internal combustion engine for an outboard motor comprising at least one combustion chamber formed by at least a engine body, a cylinder head assembly and a piston that moves relative to the engine body and the cylinder head assembly, a crankshaft that extends in a generally vertical direction and is coupled to the piston such that movement of the piston causes the crankshaft to rotate, a port that is communication with the combustion chamber, a valve moveable between open and closed positions of the port, a camshaft that is journaled for rotation and extends generally parallel to the crankshaft, the camshaft including at least one cam configured to open and close the valve, a rotor attached an upper end of the camshaft and being positioned for at least partial rotation within a housing, the rotor defining at least a first space and a second space within said housing, a driven member coupled to the housing, a drive member coupled to an upper end of the output shaft, the drive member coupled to the driven member such that rotation of the drive member is transmitted to the driven member, a control valve positioned within a common hydraulic passage having a first opening and a second opening, and a first hydraulic passage and a second hydraulic passage, the first hydraulic passage in communication with the first space and the first opening and the second hydraulic passage in communication with the second space and second opening, the control valve being configured to selectively open and close the first and second openings such that hydraulic fluid is selectively supplied to either the first space or the second space, the control valve also being positioned generally along an axis that is perpendicular to the camshaft, and a bearing cap located near an upper end of the camshaft, the bearing cap configured to cooperate with the cylinder head assembly so as to support the camshaft for rotation and at least a portion of the common hydraulic passage being formed in the bearing cap.

15. An engine as in claim 14, wherein the control valve is also positioned generally along an axis that extends transversely across the engine.

16. An engine as in claim 14, wherein the control valve is positioned near an upper end of the camshaft.

17. An engine as in claim 14, wherein at least a portion of the first hydraulic passage and second hydraulic passage are formed in the bearing cap.

18. An engine as in claim 17, wherein the port is an intake port, the valve is an intake valve and the camshaft is an intake camshaft.

19. An engine as in claim 18, further comprising an exhaust port, an exhaust valve and an exhaust camshaft that extends generally parallel to the intake camshaft, wherein the bearing cap is also configured to cooperate with the cylinder head assembly to support the exhaust camshaft for rotation, the bearing cap having a single integral body.

20. An engine as in claim 14, further comprising a cylinder head cover and wherein the control valve extends through an opening in the cylinder head cover.

21. An engine as in claim 20, wherein the opening in the head cover includes a lip and a sealing member positioned between the lip and the control valve.

22. An engine as in claim 14, further comprising a lubrication system and lubrication passages, the lubrication passages including a supply passage that is in communication with the common passage.

23. An engine as in claim 22, wherein the supply passage is defined, at least in part, in the cylinder head assembly.

24. An engine as in claim 14, wherein the port in an intake port, the valve is an intake valve and the camshaft is an intake camshaft.

25. An engine as in claim 14, wherein the port in an exhaust port, the valve in an exhaust valve and the camshaft is an exhaust camshaft.

26. An internal combustion engine for an outboard motor comprising at least one combustion chamber formed by at least a engine body, a cylinder head assembly and a piston that moves relative to the engine body and the cylinder head assembly, a crankshaft that extends in a generally vertical direction and is coupled to the piston such that movement of the piston causes the crankshaft to rotate, a port that is communication with the combustion chamber, a valve moveable between open and closed positions of the port, a camshaft that is journaled for rotation and extends generally parallel to the crankshaft, the camshaft including at least one cam configured to open and close the valve, a rotor attached an upper end of the camshaft and being positioned for at least partial rotation within a housing, the rotor defining at least a first space and a second space within said housing, a driven member coupled to the housing, a drive member coupled to an upper end of the output shaft, the drive member coupled to the driven member such that rotation of the drive member is transmitted to the driven member, a control valve positioned within a common hydraulic passage having a first opening and a second opening, and a first hydraulic passage and a second hydraulic passage, the first hydraulic passage in communication with the first space and the first opening and the second hydraulic passage in communication with the second space and second opening, the control valve being configured to selectively open and close the first and second openings such that hydraulic fluid is selectively supplied to either the first space or the second space, the control valve also being positioned generally along an axis that is perpendicular to the camshaft, the engine further comprising a system and lubrication passages, the lubrication passages including a supply passage that is in direct communication with the common passage,, wherein the supply passage is defined, at least in part, in the cylinder head assembly and a bearing cap that is located near an upper end of the camshaft, the bearing cap configured to cooperate with the cylinder head assembly so as to support the camshaft for rotation.

27. An engine as in claim 26, further in including a filter positioned in the supply passage.

28. An engine as in claim 27, wherein the filter is positioned in a filter bore that has an opening on a contact face between the cylinder head assembly and the bearing cap.

29. An engine as in claim 28, wherein the filter is positioned in the bearing cap.

30. An engine as in claim 28, wherein the filter is positioned in the cylinder head assembly.

31. An internal combustion engine for an outboard motor comprising at least one combustion chamber formed by at least a engine body, a cylinder head assembly and a piston that moves relative to the engine body and the cylinder head assembly, a crankshaft that extends in a generally vertical direction and is coupled to the piston such that movement of the piston causes the crankshaft to rotate, a port that is communication with the combustion chamber, a valve moveable between open and closed positions of the port, a camshaft that is journaled for rotation and extends generally parallel to the crankshaft, the camshaft including at least one cam configured to open and close the valve, a rotor attached an upper end of the camshaft and being positioned for at least partial rotation within a housing, the rotor defining at least a first space and a second space within said housing, a driven member coupled to the housing, a drive member coupled to an upper end of the output shaft, the drive member coupled to the driven member such that rotation of the drive member is transmitted to the driven member, a control valve positioned within a common hydraulic passage having a first opening and a second opening, and a first hydraulic passage and a second hydraulic passage, the first hydraulic passage in communication with the first space and the first opening and the second hydraulic passage in communication with the second space and the second opening, the control valve being configured to selectively open and close the first and second openings such that hydraulic fluid is selectively supplied to either the first space or the second space, the first and second openings being positioned generally at a common engine elevation, and a lubrication system and lubrication passages, the lubrication passages including a supply passage that is in direct communication with the common passage, wherein the supply passage is defined, at least in part in a bearing cap that is located near an upper end of the camshaft, the bearing cap configured to cooperate with the cylinder head assembly so as to support the camshaft for rotation.

32. An engine as in claim 31, wherein the control valve is positioned near an upper end of the camshaft.

33. An engine as in claim 31, wherein at least a portion of the first hydraulic passage and second hydraulic passage are formed in the bearing cap.

34. An engine as in claim 33, wherein the port is an intake port, the valve is an intake valve, and the camshaft is an intake camshaft.

35. An engine as in claim 34, further comprising an exhaust port, an exhaust valve and an exhaust camshaft that extends generally parallel to the intake camshaft, wherein the bearing cap is also configured to cooperate with the cylinder head assembly to support the exhaust camshaft for rotation, the bearing cap having a single integral body.

36. An engine as in claim 31, further comprising a cylinder head cover and wherein the control valve extends through an opening in the cylinder head cover.

37. An engine as in claim 36, wherein the opening in the head cover includes a lip and a sealing member positioned between the lip and the control valve.

38. An engine as in claim 31, further in including a filter positioned in the supply passage.

39. An engine as in claim 38, wherein the filter is positioned in a filter bore that has an opening on a contact face between the cylinder head assembly and the bearing cap.

40. An engine as in claim 39, wherein the filter is positioned in the bearing cap.

41. An engine as in claim 39, wherein the filter is positioned in the cylinder head assembly.

42. An engine as in claim 31, wherein the port in an intake port, the valve is an intake valve and the camshaft is an intake camshaft.

43. An engine as in claim 31, wherein the port in an exhaust port, the valve in an exhaust valve and the camshaft is an exhaust camshaft.

44. An internal combustion engine for an outboard motor comprising at least one combustion chamber formed by at least a engine body, a cylinder head assembly and a piston that moves relative to the engine body and the cylinder head assembly, a crankshaft that extends in a generally vertical direction and is coupled to the piston such that movement of the piston causes the crankshaft to rotate, a port that is communication with the combustion chamber, a valve moveable between open and closed positions of the port, a camshaft that is journaled for rotation and extends generally parallel to the crankshaft, the camshaft including at least one cam configured to open and close the valve, a rotor attached an upper end of the camshaft and being positioned for at least partial rotation within a housing, the rotor defining at least a first space and a second space within said housing, a driven member coupled to the housing, a drive member coupled to an upper end of the output shaft, the drive member coupled to the driven member such that rotation of the drive member is transmitted to the driven member, a control valve positioned within a common hydraulic passage having a first opening and a second opening, and a first hydraulic passage and a second hydraulic passage, the first hydraulic passage in communication with the first space and the first opening and the second hydraulic passage in communication with the second space and the second opening, the control valve being configured to selectively open and close the first and second openings such that hydraulic fluid is selectively supplied to either the first space or the second space, the first and second openings being positioned generally at a common engine elevation, the engine further comprising a lubrication system and lubrication passages, the lubrication passages including a supply passage that is in direct communication with the common passage wherein the supply passage is defined, at least in part, in the cylinder head assembly and a bearing cap that is located near an upper end of the camshaft, the bearing cap configured to cooperate with the cylinder head assembly so as to support the camshaft for rotation.

45. An internal combustion engine for an outboard motor comprising an engine body, a piston movable relative to the engine body, a crankshaft that extends in a generally vertical direction and is journaled for rotation by the piston, the engine body, the piston and a cylinder head assembly together defining a combustion chamber, a port in communication with the combustion chamber, a valve movable between open and closed positions of the port, a camshaft that extends generally parallel to the crankshaft and is journaled for rotation to actuate the valve in a set angular position, a variable valve timing mechanism arranged to set the camshaft to an angular position between a first angular position and a second angular portion, the first angular position being advanced as compared to the second angular position, the variable valve timing mechanism comprising a setting section-, a supply section and a control section, the control section comprising a control valve that is disposed on along an axis that is generally perpendicular to the camshaft, the supply section comprising a first hydraulic passage and a second hydraulic passage that are in hydraulic communication with the variable valve timing mechanism, the engine further comprising a lubrication system and lubrication passages, the lubrication passages including a supply passage that is in direct communication with the control section wherein the supply passage is defined, at least in part, in the cylinder head assembly and a bearing cap that is located near an upper end of the camshaft, the bearing cap configured to cooperate with the cylinder head assembly so as to support the camshaft for rotation.

46. An engine as in claim 45, further in including a filter positioned in the supply passage.

47. An engine as in claim 46, wherein the filter is positioned in a filter bore that has an opening on a contact face between the cylinder head assembly and the bearing cap.

48. An engine as in claim 47, wherein the filter is positioned in the bearing cap.

49. An engine as in claim 47, wherein the filter is positioned in the cylinder head assembly.

50. An internal combustion engine for an outboard motor comprising at least one combustion chamber formed by at least a engine body, a cylinder head assembly and a piston that moves relative to the engine body and the cylinder head assembly, a crankshaft that extends in a generally vertical direction and is coupled to the piston such that movement of the piston causes the crankshaft to rotate, a port that is communication with the combustion chamber, a valve moveable between open and closed positions of the port, a camshaft that is journaled for rotation and extends generally parallel to the crankshaft, the camshaft including at least one cam configured to open and close the valve, a rotor attached an upper end of the camshaft and being positioned for at least partial rotation within a housing, the rotor defining at least a first space and a second space within said housing, a driven member coupled to the housing, a drive member coupled to an upper end of the output shaft, the driver member, coupled to the driver member such that rotation of the driver member is transmitted to the driver member a control valve positioned within a common hydraulic passage having a first opening and a second opening, and a first hydraulic passage and a second hydraulic passage, the first hydraulic passage in communication with the first space and the first opening and the second hydraulic passage in communication with the second space and second opening, the control valve being comprising an actuator portion and a valve portion, the control valve configured to selectively open and close the first and second openings such that hydraulic fluid is selectively supplied to either the first space or the second space, and a cylinder head cover, the valve portion of the control valve lying within the cylinder head cover.

51. The engine of claim 50, wherein the actuator portion of the control valve extends at least partially through an opening in the cylinder head cover.

52. The engine of claim 51, wherein the control valve is on a side of the camshaft of the valve.

53. The engine of claim 51, wherein the control valve lies below a substantially horizontal plane which extends through at least a portion of the setting of the variable valve timing mechanism.

54. The engine of claim 53, wherein camshaft includes a plurality of cams for actuating valves, and the control valve of the variable valve timing mechanism lies above a generally horizontal plane that extends through an uppermost valve.

* * * * *

UNITED STATES PATENT AND TRADEMARK OFFICE

CERTIFICATE OF CORRECTION

PATENT NO. : 6,910,450 B2
DATED : June 28, 2005
INVENTOR(S) : Goichi Katayama

It is certified that error appears in the above-identified patent and that said Letters Patent is hereby corrected as shown below:

Column 20,
Line 15, delete “driver” and insert -- driven --.
Line 16, delete “driver member is” and insert -- drive member is --.
Line 16, delete “driver member a” and insert -- driven member, a --.
Line 33, delete “valve is” and insert -- valve lies --.
Line 34, after “camshaft” insert -- opposite --.
Line 37, after “setting” insert -- section --.

Signed and Sealed this

Thirtieth Day of May, 2006

JON W. DUDAS
*Director of the United States Patent and Trademark Office*